US008869320B1

(12) United States Patent
Santamarina et al.

(10) Patent No.: US 8,869,320 B1
(45) Date of Patent: Oct. 28, 2014

(54) COMPACT SPA JET WITH ENHANCED AIR EFFECTS

(76) Inventors: Aland Santamarina, Columbia, MD (US); Alan Romack, Columbia, MD (US)

( * ) Notice: Subject to any disclaimer, the term of this patent is extended or adjusted under 35 U.S.C. 154(b) by 1023 days.

(21) Appl. No.: 11/905,849

(22) Filed: Oct. 4, 2007

Related U.S. Application Data

(60) Provisional application No. 60/849,009, filed on Oct. 4, 2006.

(51) Int. Cl.
*A61H 33/04* (2006.01)
*A61H 33/02* (2006.01)

(52) U.S. Cl.
CPC ..... *A61H 33/027* (2013.01)
USPC ..... 4/541.6; 239/428.5; 239/589.1

(58) Field of Classification Search
USPC ..... 4/541.1–541.6; 239/225.1, 428.5, 239/589.1; 137/812, 813
See application file for complete search history.

(56) References Cited

U.S. PATENT DOCUMENTS

| | | | | |
|---|---|---|---|---|
| 3,741,481 | A * | 6/1973 | Bauer | 239/589.1 |
| 4,542,853 | A * | 9/1985 | Diamond | 239/383 |
| 6,186,409 | B1 * | 2/2001 | Srinath et al. | 239/1 |
| 6,575,386 | B1 | 6/2003 | Thurber, Jr. | |
| 6,685,102 | B1 * | 2/2004 | Mi et al. | 239/1 |
| 6,729,564 | B2 | 5/2004 | Srinath | |
| 6,904,626 | B1 * | 6/2005 | Hester et al. | 4/541.6 |
| 7,070,129 | B1 * | 7/2006 | Raghu et al. | 239/589.1 |

* cited by examiner

*Primary Examiner* — Huyen Le
*Assistant Examiner* — Erin Deery
(74) *Attorney, Agent, or Firm* — Bacon & Thomas, PLLC

(57) ABSTRACT

A spa nozzle has a fluidic oscillator for oscillating a jet of water back and forth through an outlet aperture and a pair of diverging sidewalls extending downstream of the outlet aperture for issuing a sweeping jet of water into the spa. An air entrainment port is formed in each diverging sidewall downstream of the outlet aperture. The top and bottom walls in the oscillator interaction region diverge sufficiently so as to provide a relatively large outlet aperture area but not so large as to cause the jet to roll as it exits the outlet aperture, and wherein the ratio of the depth D of the power nozzle to the width W thereof is from about 2.9 to about 3.1 and the ratio of the depth D of the outlet throat to the width W thereof is from about 4.4 to about 4.6.

11 Claims, 5 Drawing Sheets

COMPACT SPA JET WITH ENHANCED AIR EFFECTS

REFERENCE TO RELATED APPLICATION

The present invention claims the benefit of and priority of provisional application No. 60/849,009 filed Oct. 4, 2006.

BACKGROUND AND BRIEF DESCRIPTION OF THE INVENTION

Thurber, Jr. et al U.S. Pat. No. 6,575,386, entitled SPA NOZZLE WITH AIR ENTRAINMENT, issued Jun. 10, 2003, to the assignee hereof discloses a spa nozzle in which a jet of water passes over an air entrainment port downstream of the outlet. The present invention is an improvement over the Thurber, Jr. et al patent in that it relates to a small package size, oscillating fluidic for use in spa and bath products.

Increasing jet count and configurability of individual seats in hot tubs/spas and bath products are driving down the packaging envelope allowed for massage jets. These small packages are still required to have the same functionality as their larger brothers in terms of mechanical performance like shut-offs and massage performance, two key characteristics being water flow rate and airflow rate. The relatively high water flow rates and air flow rates are necessary and desirable to provide the necessary feel of the jet to provide a pleasurable, distinct massage. Use of fluidic jets, over spinners and the like, is highly desirable as they eliminate moving parts and reduce warranty costs. This type of jet is used in highly visible locations in the tub and needs to have good air for both physical feel and visual interest.

Previous fluidic spa jets have entrained air in two general locations: (1) the power nozzle region, or (2) the outlet region as disclosed in the above-mentioned Thurber, Jr. et al patent. Region 1 has the potential for entraining the most air, but the oscillator will stop working due to the large differences in the properties of air and water. Region 2 will oscillate and entrain air simultaneously. However, in the past the amount of air entrainment has been adequate for a spa application. The invention significantly improves on the latter, with the actual air-water interface on the sidewalls of the outlet region. The entrainment still occurs in the outlet region allowing stable oscillation with full air-water mixture. In fact, the quantity of air entrained relative to the quantity of water passing through the jet is more than twice any previous fluidic spa jet. In other words, the spa jet of the present invention is more than twice as effective in entraining air.

The spa nozzle disclosed herein has two distinct characteristics from previous fluidic spa nozzles: the first is the large aspect ratio, and the second is its dual air entrainment mechanism downstream of the throat.

Large aspect ratios offer a distinct packaging advantage because substantially more water flow rate can be delivered within the same circular cross-section. However, the resulting fluid mechanism have traditionally become more challenging, likely due to the formation of cross-flow patterns in the depth direction. The preferred aspect ratios (D/W) used in this nozzle are 3 (in a range of 2.9 to 3.1) at the power nozzle and 4.5 (in a range of 4.4 to 4.6) at the throat. We have found that in order for the fluidic to oscillate in a crisp, steady, and perceptible manner, the floor taper angle must not be greater than 5 degrees. In the early development stage, the nozzle had a 7 degree taper angle; its oscillation was erratic or the output jet rolled, which resulted in a muffled sensation to the end user. The taper angle was reduced to 5 degrees and later to 3 degrees. Substantial improvement was observed at both 5 and 3 degrees; but ultimately found 3 degrees to be preferred.

The dual air entrainment mechanism was developed to overcome previous mechanisms which did not provide sufficient air entrainment to satisfy or provide enhanced visual aspects. Although, in essence, the invention entrains air in a similar manner as to the previous method (by creating a low pressure region at the interface between the water jet and the air), the mechanism in this nozzle generates additional volume of air because it takes place in the plane of the oscillator as the water jet sweeps back and forth in the outlet structure. Additional volume results when the jet, due to its oscillatory nature, moves away from the air port at one of the sidewalls generating additional vacuum. A way to think about it is, low pressure is generated when there is a sudden expansion, the act of a jet rapidly moving away from the entrainment port has the effect of a sudden expansion, thus entraining additional amounts of air. Naturally, this effect is reproduced on the opposing wall and thus the presence of two air entrainment ports.

To satisfy the very constrained package space, a high aspect ratio (A-R=depth/width) is used for the fluidic circuit, 3 at the power nozzle and 4.5 at the throat is preferred. This high aspect ratio is necessary to achieve the preferred flow rate of the jet (4GPM@13PSI), and still fit in the allowable package space.

High aspect ratio jets have a tendency to produce unstable fluidic oscillators, where the cohesiveness of the stream or jet is lost. As illustrated in FIGS. 3A and 3B, this loss can be described as a stream of water that begins to skew and roll from the top of the stream to the bottom. As it rolls, the upper and lower layers of the stream begin to separate and oscillate out of phase to each other. The end result of this out-of-phase condition is that the massage effect is lost. The feel is so intuited that the user cannot determine the oscillation of the jet. The key to a good massage is the application of pressure and then the removal of said pressure. Jets that are moving out-of-phase to each other apply pressure to all contact areas all the time, as far as the nervous system of the body can tell. The relatively small contact patch on the user's body, due to proximity of the body to the jet, accentuates this problem.

As noted earlier, to prevent the rolling of the jet as it exits the nozzle, the floor taper angles are controlled as shown in FIG. 1B. Packaging requirements restricted the width of the interaction region, thus relatively large taper angles were needed to have the necessary throat area. However, if the angles exceeded the final design taper angles (about 3 degrees to no more than about 5 degrees), the jet rolled as it exited the nozzle.

Additionally, the tight packaging space required special manufacturing and assembly methods to be employed. The fluidic circuit geometry was split into three different components in the final assembly. As disclosed in Thurber, Jr., the fluidic circuit was packaged as a "wall-less" circuit to gain additional width normally consumed by the insert walls. The insert housing serves not only to hold the circuit, but acts as the outside walls of the feedback channels. The top of the communication port for the feedback channel forward to the throat was moved to a separate component.

The invention features a spa nozzle for use underwater having a water supply and an air supply, a fluidic oscillator for oscillating a jet of water back and forth, said fluidic oscillator having an interaction region and a pair of control ports at the upstream end of said interaction region and a power nozzle connected to said water supply for projecting a jet of water into said interaction region, a pair of feedback passages connecting said control ports with a downstream end of said interaction region, and said interaction region having an outlet aperture and a pair of diverging sidewalls extending downstream of said outlet aperture for issuing a sweeping jet of water into said spa, said power nozzle and said outlet aperture having a width W and a depth D, and said interaction region having sidewalls that diverge from said power nozzle and converge to said outlet aperture and a top and a bottom wall, the improvement wherein an air entrainment port is formed in each diverging side wall of said pair of diverging sidewalls downstream of said outlet aperture in alternating communication with said air supply as said jet of water is oscillated back and forth by said fluidic oscillator and provide enhanced air effects.

The invention further features a spa nozzle for use underwater, a water supply and an air supply, a fluidic oscillator for oscillating a jet of water back and forth, said fluidic oscillator having an interaction region and a pair of control ports at the upstream end of said interaction region and a power nozzle connected to said water supply for projecting a jet of water into said interaction region, a pair of feedback passages connecting said control ports with a downstream end of said interaction region, and said interaction region having an outlet aperture and a pair of diverging sidewalls extending downstream of said outlet aperture for issuing a sweeping jet of water into said spa, said power nozzle and said outlet aperture having a width W and a depth D, and said interaction region having sidewalls that diverge from said power nozzle and converge to said outlet aperture and a top and a bottom wall, the improvement wherein said top and bottom walls in said interaction region diverge sufficiently so as to provide a relatively large outlet aperture area but not so large as to cause said jet to roll as it exits said outlet aperture, e.g. no more than about 5 degrees and not less than about 3 degrees.

The invention further features a spa nozzle for use underwater, a water supply and an air supply, a fluidic oscillator for oscillating a jet of water back and forth, said fluidic oscillator having an interaction region and a pair of control ports at the upstream end of said interaction region and a power nozzle connected to said water supply for projecting a jet of water into said interaction region, a pair of feedback passages connecting said control ports with a downstream end of said interaction region, and said interaction region having an outlet aperture and a pair of diverging sidewalls extending downstream of said outlet aperture for issuing a sweeping jet of water into said spa, said power nozzle and said outlet aperture having a width W and a depth D, and said interaction region having sidewalls that diverge from said power nozzle and converge to said outlet aperture and a top and a bottom wall. The ratio of the depth D of said power nozzle to the width W thereof is from about 2.9 to about 3.1 and the ratio of the depth D of said outlet throat to the width W thereof is from about 4.4 to 4.6.

The invention further features a spa nozzle for use underwater, water supply and an air supply, a fluidic oscillator for oscillating a jet of water back and forth, said fluidic oscillator having an interaction region and a pair of control ports at the upstream end of said interaction region and a power nozzle connected to said water supply for projecting a jet of water into said interaction region, a pair of feedback passages connecting said control ports with a downstream end of said interaction region, and said interaction region having an outlet aperture and a pair of diverging sidewalls extending downstream of said outlet aperture for issuing a sweeping jet of water into said spa, said power nozzle and said outlet aperture having a width W and a depth D, and said interaction region having sidewalls that diverge from said power nozzle and converge to said outlet aperture and a top and a bottom wall. An air entrainment port is formed in each diverging side wall of said pair of diverging sidewalls downstream of said outlet aperture in alternating communication with said air supply as said jet of water is oscillated back and forth by said fluidic oscillator, and wherein said top and bottom walls in said interaction region diverge sufficiently so as to provide a relatively large outlet aperture area but not so large as to cause said jet to roll as it exits said outlet aperture, and wherein the ratio of the depth D of said power nozzle to the width W thereof is from about 2.9 to about 3.1 about and the ratio of the depth D of said outlet throat to the width W thereof is from about 4.4 to about 4.6.

BRIEF DESCRIPTION OF THE DRAWINGS

The above and other objects, advantages and features of the invention will become more apparent when considered with the accompanying specification and drawings wherein.

DETAILED DESCRIPTION OF THE INVENTION

Figure 1A:
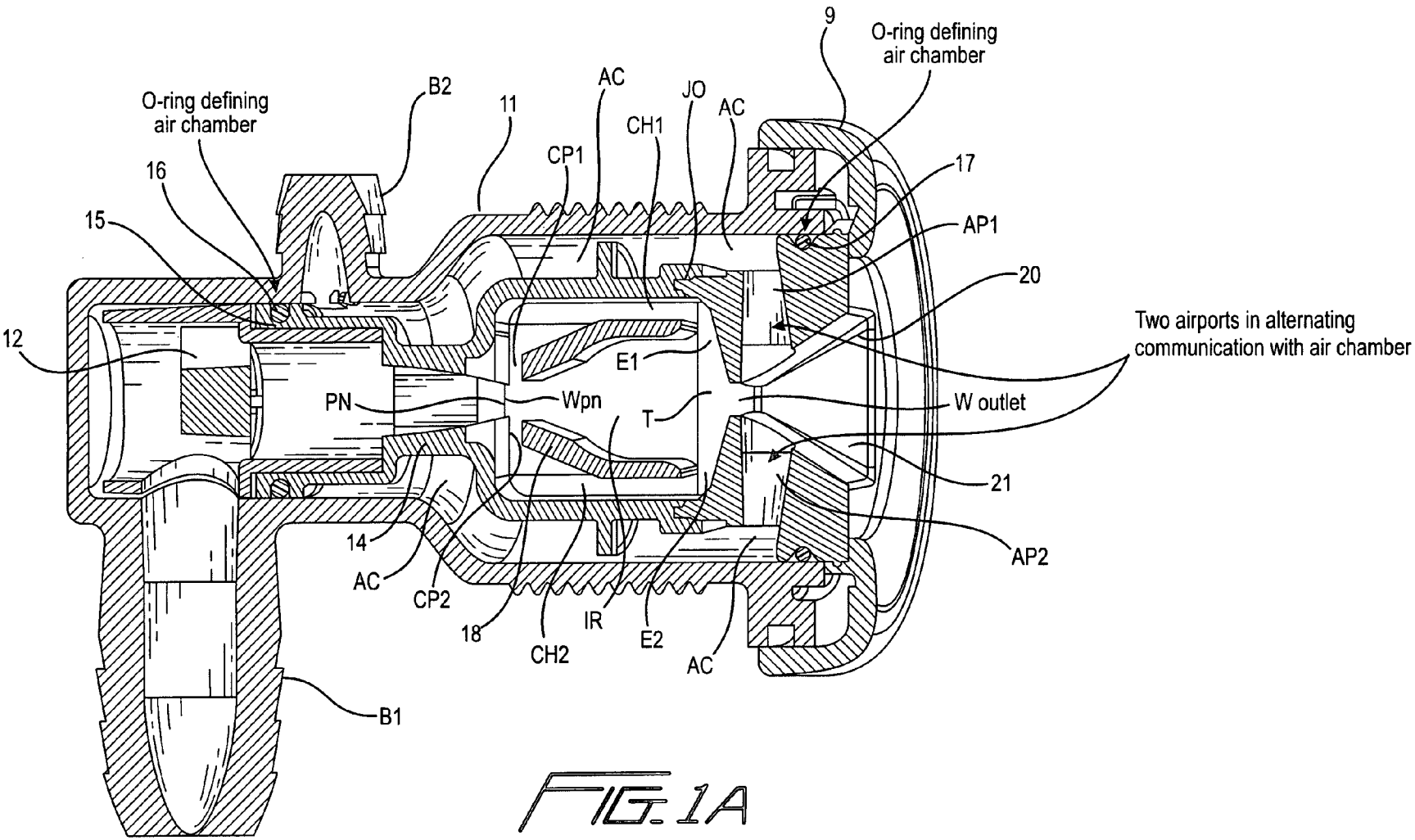
FIG. 1A is a cut-away isometric view of a spa nozzle incorporating the invention.
Figure 1B:
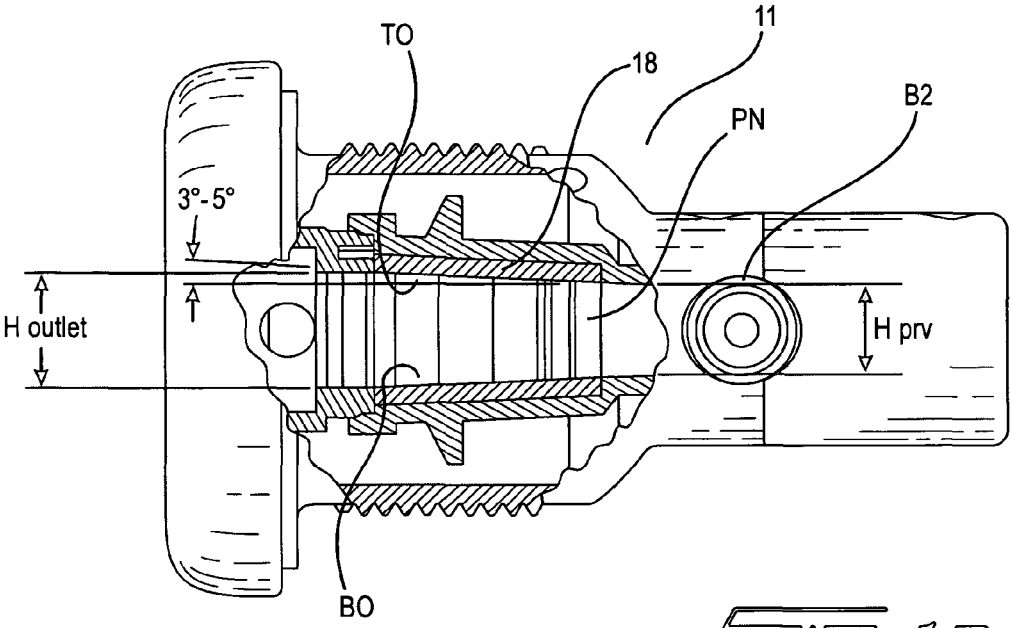
FIG. 1B is a cut-away plan view of a spa nozzle incorporating the invention.
Figure 6:
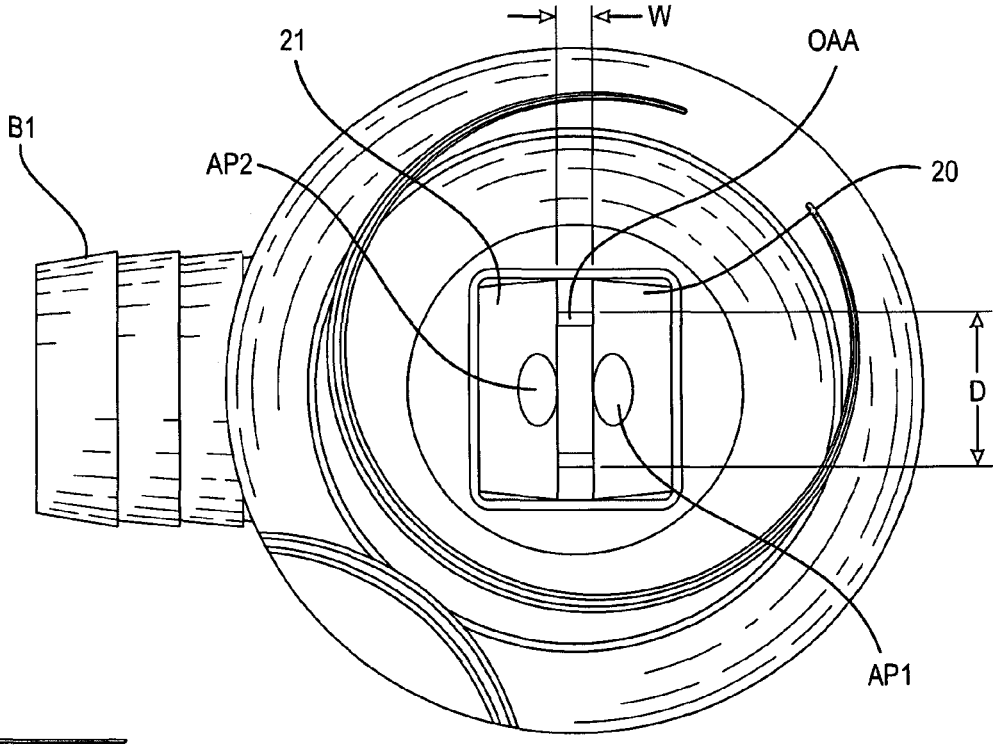
FIG. 6 is a front view of the spa nozzle showing the outlet aperture and the dual air aspiration ports.
Figure 2A:
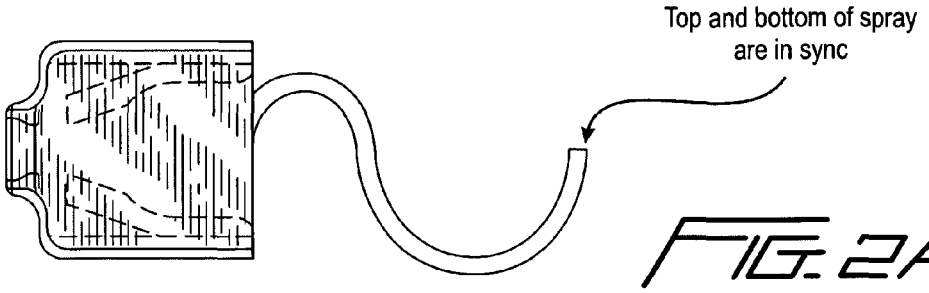
FIG. 2A is a top plan view showing the enhanced high feel oscillation view.
Figure 2B:
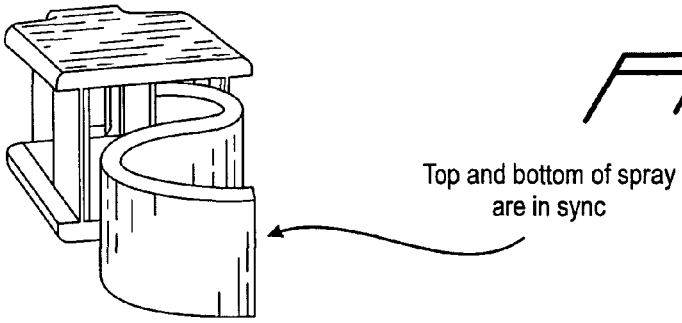
FIG. 2B is a perspective view of FIG. 2A, both views FIG. 2A and FIG. 2B showing the top and bottom of the spray are in synchronization.
Figure 3A:
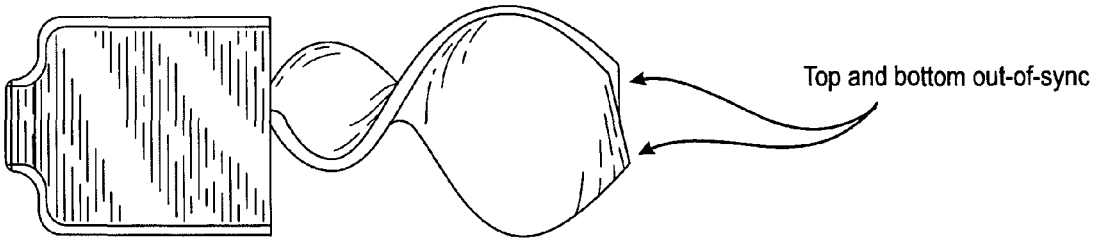
FIGS. 3A and 3B show the twisted outlet spray with the top and bottom of the output spray are twisted or out of synchronization.
Figure 3B:
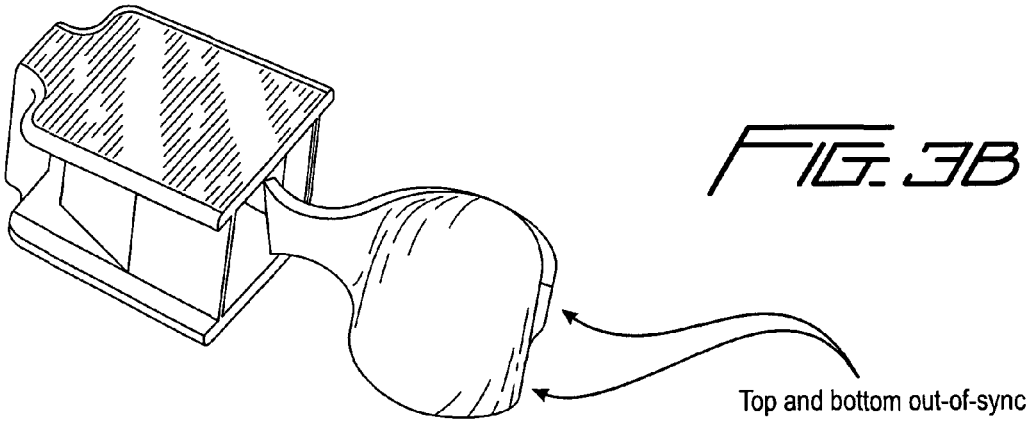

As shown in the drawings, a molded, threaded housing H has a water input barb B1 and an air input barb B2 coupled respectively to water and air supplies (not shown). The water input barb B1 feeds a conventional flow straightener 12 which feeds water to a power nozzle PN in the fluidic oscillator. A molded fluidic housing 14 has a seat 15 for an O-ring 16 which in conjunction with O-ring 17 forms an air chamber AC (FIG. 1A) coupled to air barb B2. Fluidic insert 18 incorporates the power nozzle PN and the interaction regional IR. Feedback channels CH1 and CH2 are formed between the walls of the fluidic housing and the insert 18. After the fluidic insert 18 is inserted in fluidic housing 14, the fluidic outlet FO is attached by welding (sonic, RF, etc.) or adhesive at joint JO. Outlet OB is secured or attached to the fluidic outlet FO in a similar fashion. The air chamber formed between the two O-rings 16 and 17 is coupled to a pair of air ports AP1 and AP2, respectively, which are formed in the diverging sidewalls 20 and 21. Entrances to the oscillator feedback channels E1 and E2, respectively, feed the feedback channels which supply control signals to control ports CP1 and CP2, respectively. In operation, water under pressure enters the barb B1 passing through the large elbow at the rear of the nozzle housing 11 and goes through the flow straightener 12 which conditions the swirling flow pattern. The power nozzle PN generates a jet that expands in a controlled fashion in the interaction region IR allowing the oscillation to develop. As the oscillating jet passes through the throat T, it sweeps back and forth between outlet walls 20 and 21. As it flows past air ports AP1 and AP2, low pressure is communicated to the air chamber formed between the O-rings 16 and 17. As shown in FIG. 1B, the top TO and bottom BO walls in said interaction region diverge sufficiently, greater than about 3 degrees and no more than about 5 degrees (FIG. 1B), so as to provide a relatively large outlet aperture area (OAA, FIG. 6) but not so large as to cause said jet to roll as it exits said outlet aperture (see FIGS. 3A and 3B), and wherein the ratio of the depth D of said power nozzle to the width W thereof is from about 2.9 to about 3.1 and the ratio of the depth D of said outlet throat to the width W thereof (FIG. 6) is from about 4.4 to about 4.6. The small barb B2 and the nozzle housing is used to connect the air line to deliver atmospheric air to the chamber. Because the exit of the nozzle is expanded to entrain air, the jet emanating from the nozzle is very well aerated compared to other fluidics with a relatively low exit velocity. The end result is a nozzle that gives a soft, pillowy, but still distinct feel.

This spa jet nozzle is especially adapted for use on the neck and wrist, that is, useful for other spa jet problems. It will be noted that the device is particularly adapted for submerged or underwater operation.

Figure 4:
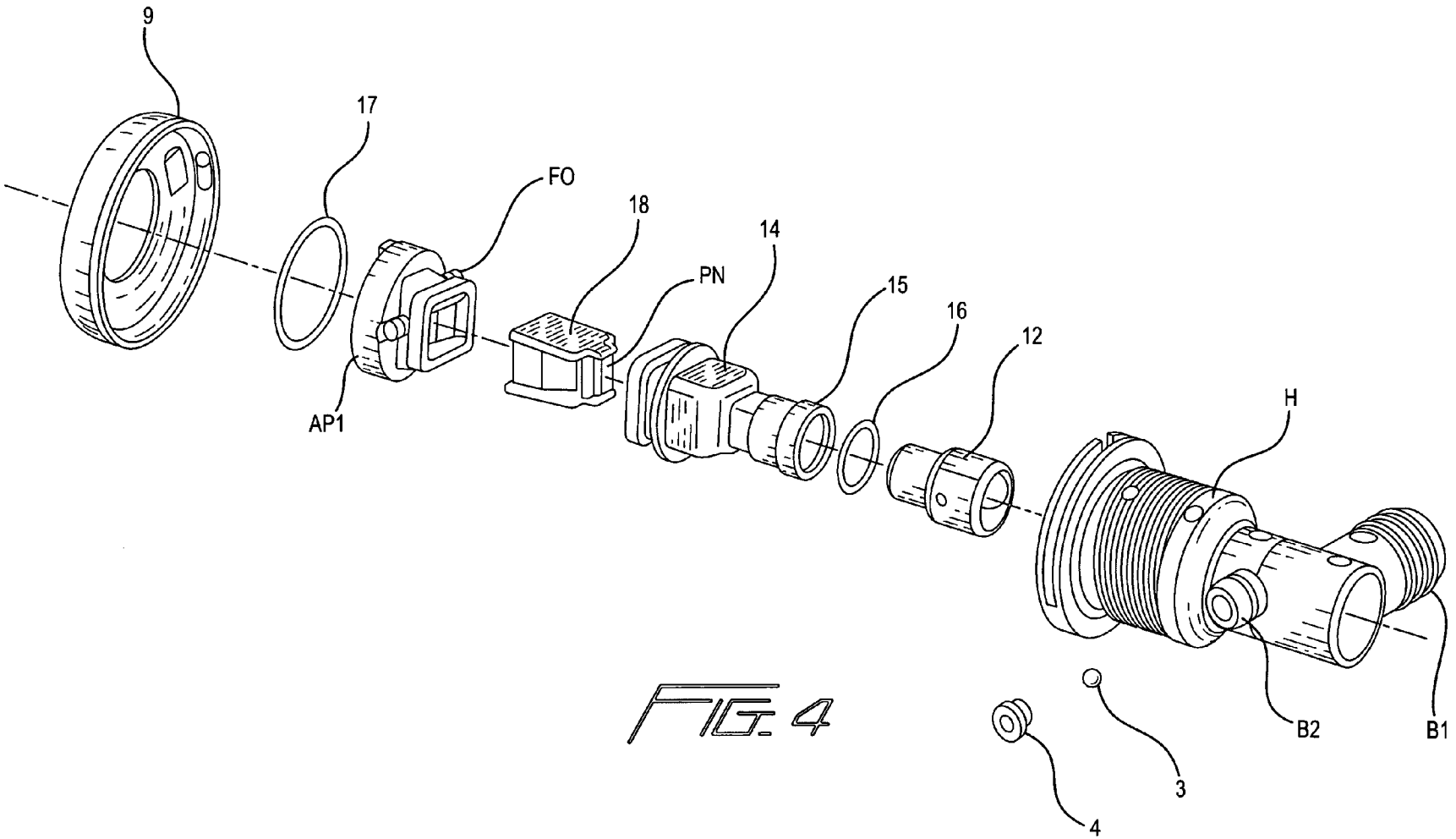
FIG. 4 is an exploded isometric view.
Figure 5:
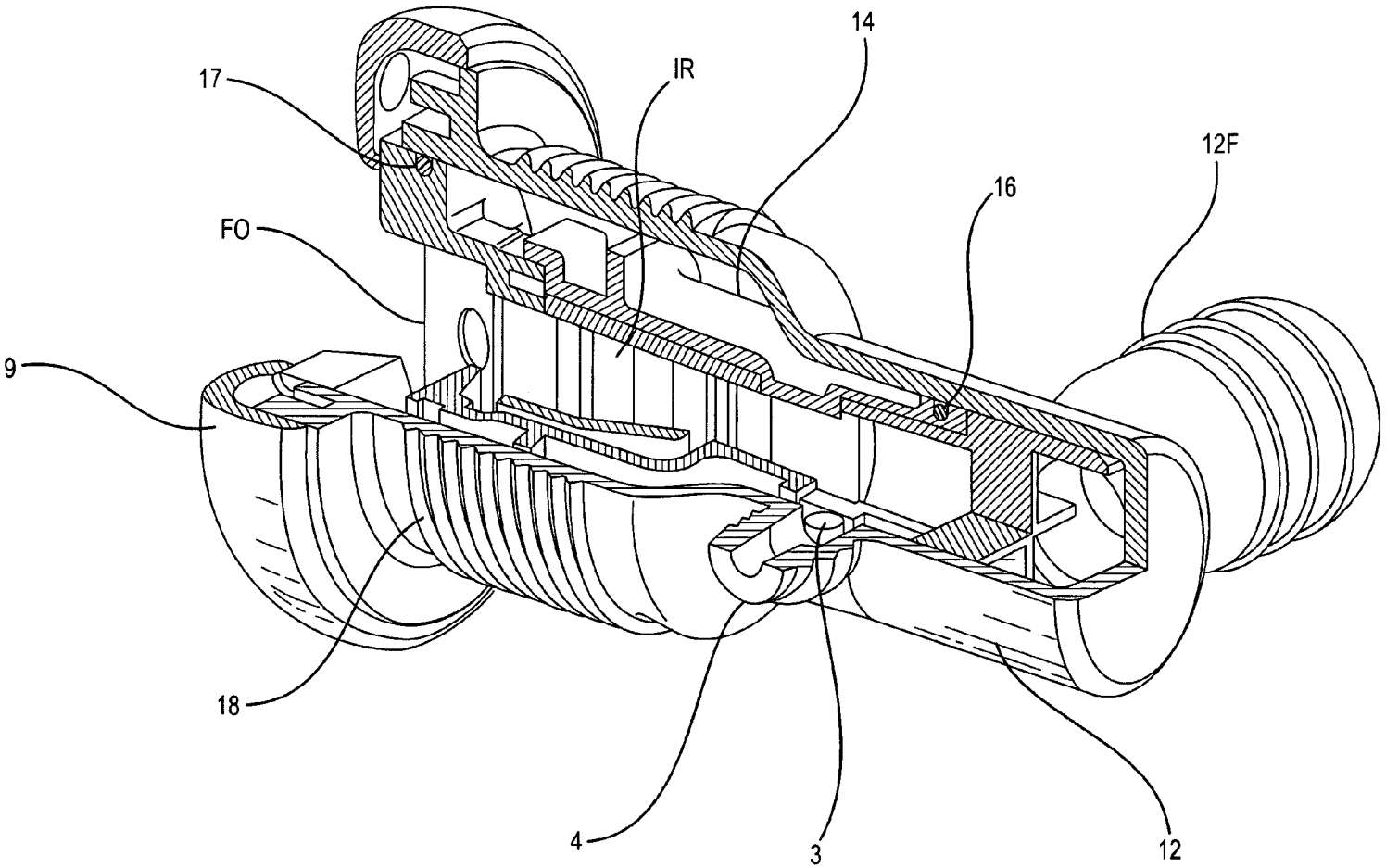
FIG. 5 shows the assembled spa jet nozzle with a cut-away to show the interrelationship of the parts.

The exploded view (FIG. 4) shows all the components comprising the nozzle.

16, 17 O-rings. Serve to isolate the entrained air from the water.

3 Ball, used to seal against ball seat (4) to prevent back flow of water when the nozzle is off.

4 Ball seat (see #3).

FO The fluidic outlet, forms the throat of the fluidic and the expansion chamber that generates a low pressure region for air to be entrained.

14 Fluidic housing. Used to house the fluidic insert (18). It forms the outer walls of the feedback channels.

18 Fluidic insert. Primary fluidic piece. It incorporates the power nozzle, interaction region, and feedback channels (wall-less).

H Nozzle housing.

9 Bezel

12 Flow conditioner and control. This piece is used to control the flow rate that is delivered to the fluidic. It also incorporates a flow conditioner that minimizes the effects of poor inlet geometry.

Because the exit of the nozzle is expanded to entrained air, the jet emanating from this nozzle is very well aerated (compared to other fluidics) and with relatively low exit velocity.

This spa jet nozzle is especially for use as a neck jet and a wrist jet. Improvements over prior devices are in the areas of deep circuit, better air entrainment and efficient packaging.

While the invention has been described in relation to preferred embodiments of the invention, it will be appreciated that other embodiments, adaptations and modifications of the invention will be apparent to those skilled in the art.

What is claimed is:

1. A spa nozzle for use underwater, comprising:

a water supply and an air supply, and a fluidic oscillator for oscillating a jet of water back and forth, said fluidic oscillator having an interaction region and a pair of control ports at the upstream end of said interaction region and a power nozzle connected to said water supply for projecting a jet of water into said interaction region, a pair of feedback passages connecting said control ports with a downstream end of said interaction region, and said interaction region having an outlet aperture, said power nozzle and said outlet aperture having a width and a depth, said interaction region having sidewalls that diverge from said power nozzle and converge to said outlet aperture and a top and a bottom wall, and said spa nozzle further including additional diverging sidewalls extending downstream of said outlet aperture for issuing a sweeping jet of water into a spa, wherein said power nozzle generates a jet of water that expands in the interaction region allowing an oscillation of said jet to develop, wherein an air entrainment port is formed in each of said diverging side walls downstream of said outlet aperture of said interaction region, and wherein said oscillating jet of water causes low pressure regions to alternately develop as said jet alternatingly moves away from said air entrainment ports to cause air from said air entrainment ports to be alternately entrained by said jet of water as said jet of water oscillates between said diverging sidewalls downstream of said outlet aperture of said interaction region.

2. The spa nozzle defined in claim 1 wherein said top and bottom walls in said interaction region diverge sufficiently so as to provide a relatively large outlet aperture area but not so large as to cause said jet to roll as it exits said outlet aperture, a taper angle of said top and bottom walls being between three degrees and five degrees.

3. The spa nozzle defined in claim 1 wherein the ratio of the depth of said power nozzle to the width thereof is from about 2.9 to about 3.1 and the ratio of the depth of said outlet throat to the width thereof is from about 4.4 to about 4.6.

4. A spa nozzle for use underwater, comprising:

a water supply and an air supply, and a fluidic oscillator for oscillating a jet of water back and forth, said fluidic oscillator having an interaction region and a pair of control ports at the upstream end of said interaction region and a power nozzle connected to said water supply for projecting a jet of water into said interaction region, a pair of feedback passages connecting said control ports with a downstream end of said interaction region, and said interaction region having an outlet aperture, said power nozzle and said outlet aperture having a width and a depth, said interaction region having sidewalls that diverge from said power nozzle and converge to said outlet aperture and a top and a bottom wall, and said spa nozzle further comprising additional diverging sidewalls extending downstream of said outlet aperture for issuing a sweeping jet of water into a spa, wherein said power nozzle generates a jet of water that expands in the interaction region allowing an oscillation of said jet to develop, wherein said top and bottom walls in said interaction region diverge sufficiently so as to provide a relatively large outlet aperture area but not so large as to cause said jet to roll as it exits said outlet aperture, taper angle of said top and bottom walls being between three degrees and five degrees.

5. The spa nozzle defined in claim 4 wherein an air entrainment port is formed in each diverging side wall of said pair of diverging sidewalls downstream of said outlet aperture and wherein said oscillating jet of water causes low pressure regions to alternately develop as said jet alternatingly moves away from said air entrainment ports to cause air from said air entrainment ports to be alternately entrained by said jet of water as said jet of water oscillates between said diverging sidewalls of said interaction region.

6. The spa nozzle defined in claim 4 wherein the ratio of the depth of said power nozzle to the width thereof is from about 2.9 to about 3.1 and the ratio of the depth of said outlet throat to the width thereof is from about 4.4 to about 4.6.

7. A spa nozzle for use underwater, comprising:

a water supply and an air supply, and a fluidic oscillator for oscillating a jet of water back and forth, said fluidic oscillator having an interaction region and a pair of control ports at the upstream end of said interaction region and a power nozzle connected to said water supply for projecting a jet of water into said interaction region, a pair of feedback passages connecting said control ports with a downstream end of said interaction region, and said interaction region having an outlet aperture, said power nozzle and said outlet aperture having a width and a depth, said interaction region having sidewalls that diverge from said power nozzle and converge to said outlet aperture and a top and a bottom wall, and said spa nozzle further comprising additional diverging sidewalls extending downstream of said outlet aperture for issuing a sweeping jet of water into a spa, wherein said power nozzle generates a jet of water that expands in the interaction region allowing an oscillation of said jet to develop, and wherein the ratio of the depth of said power nozzle to the width thereof is from about 2.9 to about 3.1 and the ratio of the depth of said outlet aperture to the width thereof is from about 4.4 to about 4.6.

8. The spa nozzle defined in claim 7 wherein said top and bottom walls in said interaction region diverge sufficiently so as to provide a relatively large outlet aperture area but not so large as to cause said jet to roll as it exits said outlet aperture, a taper angle of said top and bottom walls being between three degrees and five degrees.

9. The spa nozzle defined in claim 7 wherein an air entrainment port is formed in each diverging side wall of said pair of diverging sidewalls downstream of said outlet aperture and wherein said oscillating jet of water causes low pressure regions to alternately develop as said jet alternatingly moves away from said air entrainment ports to cause air from said air entrainment ports to be alternately entrained by said jet of water as said jet of water oscillates between said diverging sidewalls of said interaction region.

10. A spa nozzle for use underwater, comprising:

a water supply and an air supply, and a fluidic oscillator for oscillating a jet of water back and forth, said fluidic oscillator having an interaction region and a pair of control ports at the upstream end of said interaction region and a power nozzle connected to said water supply for projecting a jet of water into said interaction region, a pair of feedback passages connecting said control ports with a downstream end of said interaction region, and said interaction region having an outlet aperture, said power nozzle and said outlet aperture having a width and a depth, said interaction region having sidewalls that diverge from said power nozzle and converge to said outlet aperture and a top and a bottom wall, and said spa nozzle further comprising additional diverging sidewalls extending downstream of said outlet aperture for issuing a sweeping jet of water into a spa, wherein said power nozzle generates a jet of water that expands in the interaction region allowing an oscillation of said jet to develop, wherein an air entrainment port is formed in each diverging side wall of said pair of diverging sidewalls downstream of said outlet aperture and wherein said oscillating jet of water causes low pressure regions to alternately develop as said jet alternatingly moves away from said air entrainment ports to cause air from said air entrainment ports to be alternately entrained by said jet of water as said jet of water oscillates between said diverging sidewalls of said interaction region, wherein said top and bottom walls in said interaction region diverge sufficiently so as to provide a relatively large outlet aperture area but not so large as to cause said jet to roll as it exits said outlet aperture, a taper angle of said top and bottom walls being between three degrees and five degrees, and wherein the ratio of the depth of said power nozzle to the width thereof is from about 2.9 to about 3.1 and the ratio of the depth of said outlet throat to the width thereof is from about 4.4 to about 4.6.

11. The spa nozzle defined in claim 1, further comprising an air chamber formed between the air supply and air entrainment ports around the fluidic oscillator coupled to the air supply and each of the air entrainment ports formed in each of the diverging side walls.

* * * * *